US006270230B1

(12) United States Patent
Mai

(10) Patent No.: US 6,270,230 B1
(45) Date of Patent: Aug. 7, 2001

(54) UMBRELLA WITH ALERT DEVICE

(76) Inventor: Kuei Ying Mai, 1103 S. San Gabriel, Suite E, San Gabriel, CA (US) 91776

( * ) Notice: Subject to any disclaimer, the term of this patent is extended or adjusted under 35 U.S.C. 154(b) by 0 days.

(21) Appl. No.: 09/344,670

(22) Filed: Jun. 25, 1999

Related U.S. Application Data

(62) Division of application No. 09/146,515, filed on Sep. 3, 1998, now Pat. No. 5,954,417.

(51) Int. Cl.[7] ..... A45B 3/02
(52) U.S. Cl. ..... 362/102; 362/800; 135/910
(58) Field of Search ..... 362/102, 800, 362/234; 135/910, 16

(56) References Cited

U.S. PATENT DOCUMENTS 4,601,120 * 7/1986 Levin ..... 40/317
4,860,179 * 8/1989 Mui et al. ..... 362/102
5,323,798 * 6/1994 Yang ..... 362/102
5,502,624 * 3/1996 Tu ..... 362/102

* cited by examiner

*Primary Examiner*—Thomas M. Sember
(74) *Attorney, Agent, or Firm*—Raymond Y. Chan; David and Raymond Patent Group

(57) ABSTRACT

An umbrella with alert device includes a circular umbrella cover made of waterproof fabric or plastic material, an umbrella frame for supporting the umbrella cover to form an umbrella body, and an alert device for providing visual warning signal to others on the road. The alert device includes a battery receiver mounted below the umbrella cover, a battery stored within the battery receiver for providing power supply, a plurality of LEDs which are electrically connected with each other and the battery by electrical wires and spacedly disposed around an outer edges of the gores, a transparent strip water-sealedly welded on the outer edges of the panels by ultrasonic welding or sewed on the outer edges of the gores to cover the LEDs and the electrical wires, and a power switch electrically connected to the battery for controlling on and off of the alert device. The umbrella with alert device is specifically designed to enhance the visibility of the user during nighttime raining condition, so that the user can be more easily located by the drivers on the road, so as to avoid accident.

10 Claims, 6 Drawing Sheets

UMBRELLA WITH ALERT DEVICE

CROSS REFERENCE OF RELATED ART

This is a divisional application for a utility application, application Ser. No. 09/146,515, filed Sep. 3, 1998, now U.S. Pat. No. 5,954,417.

FIELD OF THE PRESENT INVENTION

The present invention relates to an umbrella, and more particularly to an umbrella with visual alert device for enhancing the visibility of the user during raining night.

BACKGROUND OF THE PRESENT INVENTION

The design of umbrella is not only limited to block out rain, but also can be used to block out sun light radiation. Normally, the umbrella is used during daytime to either block out the sun light radiation during sunny weather condition or block out rain during raining weather condition. During nighttime, the umbrella is only used to block out rain during raining weather condition. During raining weather condition, the visibility is very poor, especially during heavy down pouring. The problem with low visibility is magnify at nighttime when the degree of brightness is much lower than daytime.

For those who need to travel on the street during nighttime raining condition, not only do they have to battle with cold and wet weather, but also the road is full of hazardous condition. It is extremely difficult for a driver in a vehicle to see the pedestrian walking across the street under raining weather condition during nighttime. This is especially true for umbrella which has dark color. Even if the umbrella is in shining color such as yellow or bright red, during nighttime raining condition, the vision of the driver is still relatively low in compare to daytime sunny weather condition. Although most drivers are much more cautious under such hazardous condition, but accidents happened during nighttime raining weather condition are still at an alarming rate.

SUMMARY OF THE PRESENT INVENTION

The main objective of the present invention is to provide an umbrella with alert device which is especially design to enhance the visibility of the user during nighttime raining condition, so that the user can be more easily located by the drivers on the road, so as to avoid accident.

Another objective of the present invention is to provide an umbrella with alert device, which is easy to manufacture in relatively low cast and can better decorate the outlook of the umbrella.

Accordingly, in order to accomplish the above objectives, the present invention provides an umbrella with alert device which comprises a circular umbrella cover made of waterproof fabric or plastic material, an umbrella frame for supporting the umbrella cover to form an umbrella body, and an alert device for providing visual warning signal to others on the road. The umbrella cover comprises a plurality of gores sewing edge to edge to form a circular configuration. The umbrella frame comprises a rod, a plurality of ribs each having a first end intervally jointed at an upper portion of said rod and a second end extended outwardly and downwardly to form a tip for supporting the umbrella cover by fastening the gores thereof on the ribs, a runner slidably mounted on said rod, a plurality of stretchers each having a first end pivotally jointed at the runner and a second end pivotally jointed at a middle position of the respective rib, and a controlling means for operating the umbrella frame to stretch out to open the umbrella or to fold up to close the umbrella.

The alert device comprises a battery receiver mounted below the umbrella cover, a battery stored within the battery receiver for providing power supply, a plurality of LEDs which are electrically connected with each other and the battery by electrical wires and spacedly disposed around an outer edges of the gores, a transparent strip water-sealedly welded on the outer edges of the panels by ultrasonic welding or sewed on the outer edges of the gores to cover the LEDs and the electrical wires, and a power switch electrically connected to the battery for controlling on and off of the alert device.

DETAILED DESCRIPTION OF THE PREFERRED EMBODIMENTS

Figure 1:
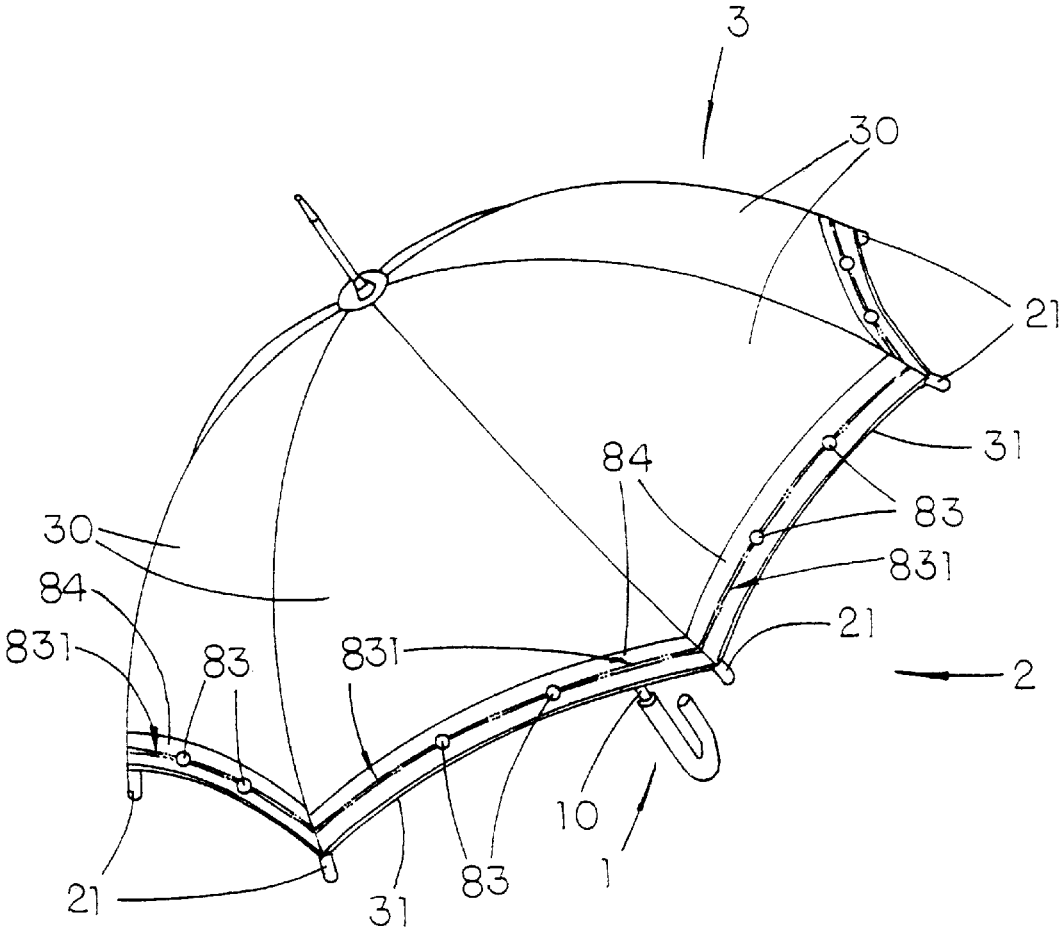
FIG. 1 is a top perspective view of an umbrella with alert device according to a first preferred embodiment of the present invention.
Figure 2:
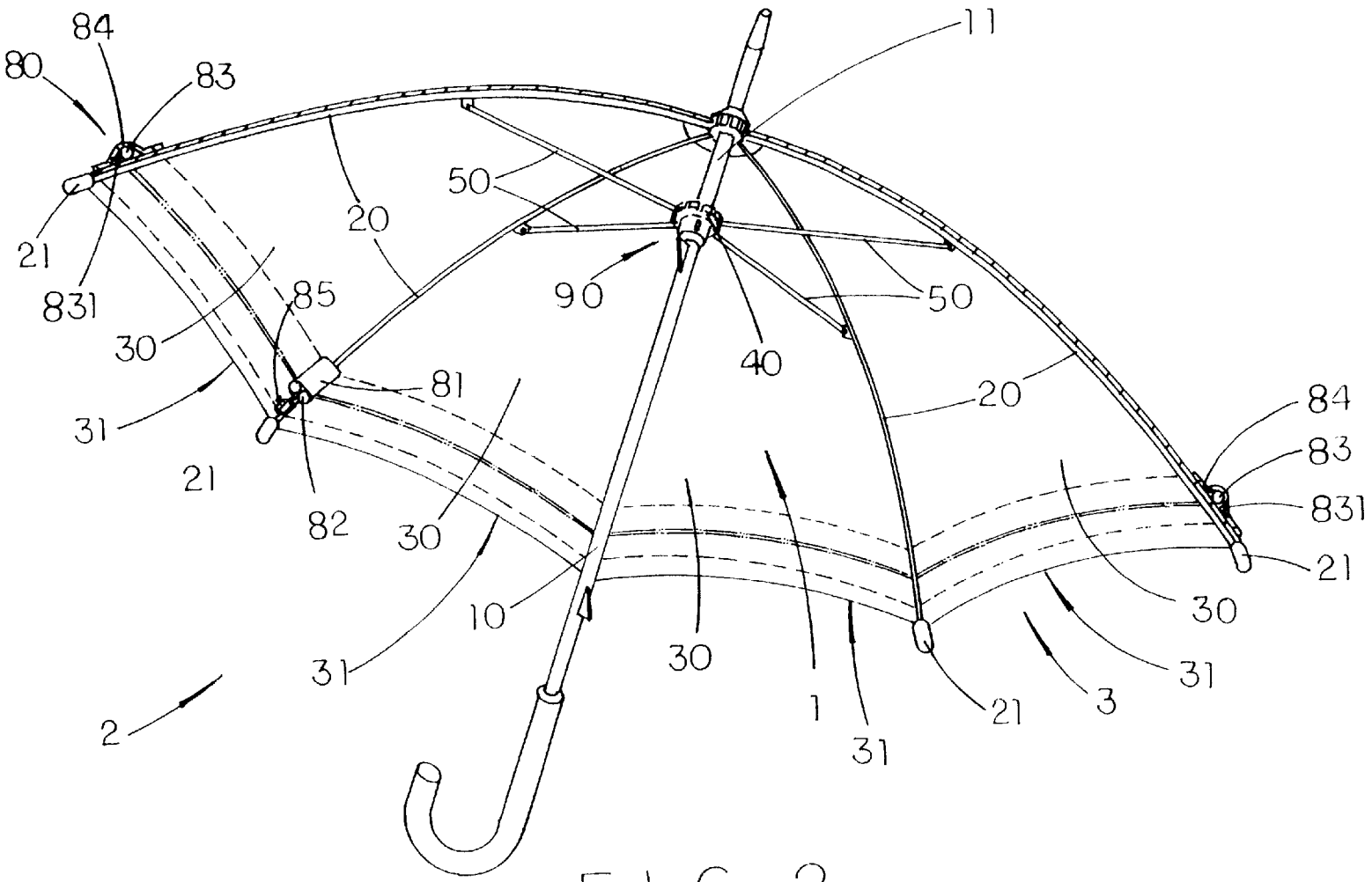
FIG. 2 is a sectional perspective view of the umbrella with alert device according to the above first preferred embodiment of the present invention.

Referring to FIGS. 1 and 2 of the drawings, an umbrella with alert device according to a first preferred embodiment of the present invention is illustrated, which comprises an umbrella frame 1 for supporting a circular umbrella cover 3 made of water proof fabric or plastic material to form an umbrella body 2, and an alert device 80 for providing visual warning signal to others on the road.

The umbrella cover 3 comprises a plurality of gores 30 sewing edge to edge to form a circular covering. The umbrella frame 1 comprises a rod 10, a plurality of ribs 20 each having a first end jointed at an upper portion 11 of the rod 10 and a second end extended outwardly and downwardly to form a tip 21 for supporting the umbrella cover 3 by fastening the gores 30 thereof on the ribs 20 respectively, a runner 40 slidably mounted on the rod 10, a plurality of stretchers 50 each having a first end pivotally jointed at the runner 40 and a second end pivotally jointed at a middle position of the respective rib 20, and a controlling means 90 for operating the umbrella frame 1 to fully stretch out to open the umbrella or to fold up to close the umbrella.

The alert device 80 comprises a battery receiver 81 mounted below the umbrella cover 3, at least a battery 82 stored within the battery receiver 81 for providing power supply, a plurality of LEDs 83 intervally distributed on the gores 30 of the umbrella cover 3, which are electrically connected with each other and the battery 82 by electrical wires 831 to form an electrical circuit, at least a transparent strip 84 water-sealedly affixed on the umbrella cover 3 to cover the LEDs 83 and the electrical wires 831 disposed on the gores 30 of the umbrella cover 3 for sealedly isolating the LEDs 83 from outside and holding the LEDs 83 in position, and a power switch 85 electrically connected to the battery 82 for switching on and off the alert device 80.

According to the first preferred embodiment of the present invention, the battery receiver 81 is attached to the underside of the umbrella cover 3 and the plurality of LEDs 83 are spacedly disposed around outer edges 31 of the gores 30 of the umbrella cover 3. The electrical wires 831, which are connected between every two LEDs 83, are also extended along the outer edges 31 of the gores 30. In order to further affix the LEDs 83 and the electrical wires 831 on the gores 30, the LEDs 83 and the electrical wires 831 can respectively be sewed or glued to the top surfaces of the gores 30. The transparent strip 84 is made of waterproof material such as transparent PVC strip, which is extended along the outer edges 31 of the gores 83 of the umbrella cover 80 to cover all the LEDs 83 and the electrical wires 831, wherein two sides of the transparent strip 84 are sealedly welded on the outer edges 31 of the gores 30 of the umbrella cover 3 by ultrasonic welding or sewed on the outer edge 31 of the gores 30 for preventing any water or moisture from contacting with the LEDs 831 and the electrical wires 831.

In other words, a series of LEDs 83 are intervally aligned along the periphery edge of the umbrella cover 3. Therefore, when a user of the umbrella of the first preferred embodiment of the present invention is uses the umbrella at rainy night, the user may switch on the alert device 80 by operating the power switch 85. Then, the battery 82 provides electricity to light up all the LEDs 83 disposed around the periphery edge of the umbrella cover 3, so that the drivers around the user can easily aware the location of the user through the lighting LEDs 83 to prevent accident. It is worth to mention that the power switch 85 can be incorporated with the controlling means 90 so that once the user open the umbrella, the LEDs 83 would be automatically lighted up, and that when the user close the umbrella, the LEDs 83 would be automatically switched off.

Figure 3:
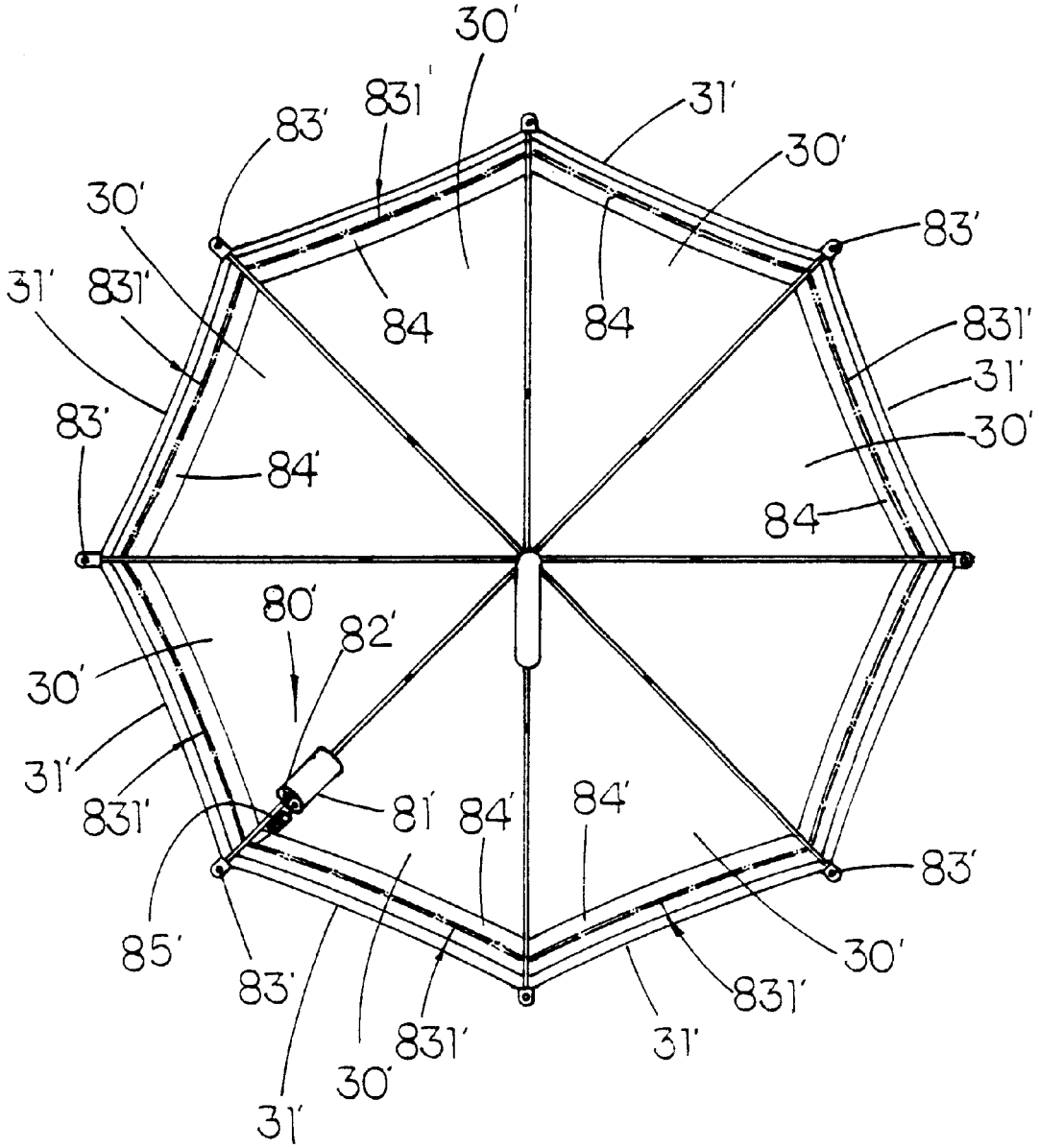
FIG. 3 is a bottom view of an umbrella with alert device according to a second preferred embodiment of the present invention.
Figure 4:
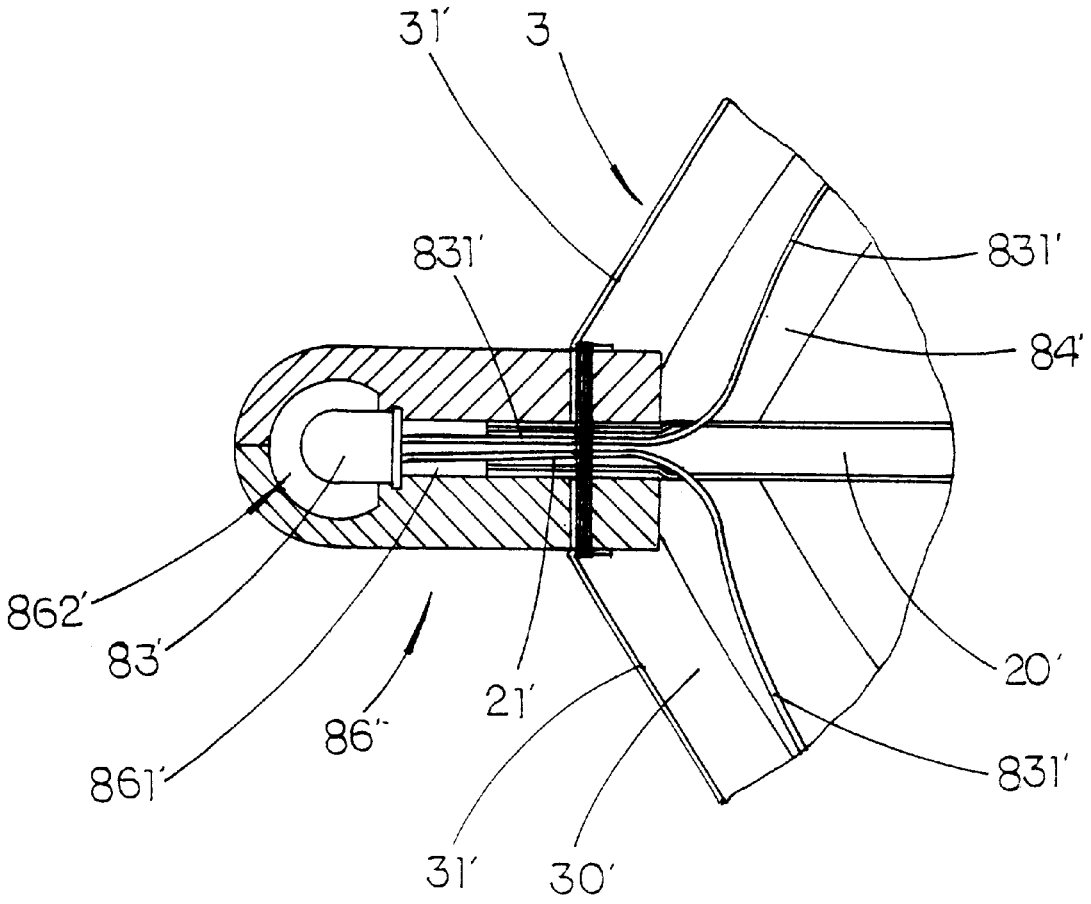
FIG. 4 is a detail sectional view illustrating an LED disposed within a light housing of the alert device according to the above second preferred embodiment of the present invention.

Referring to FIGS. 3 and 4 of the drawings, an alternative mode of the umbrella with alert device according to a second preferred embodiment of the present invention is illustrated. The alert device 80' also comprises a battery receiver 81' mounted on the underside of the umbrella cover 3', at least a battery 82' stored within the battery receiver 81' for providing power supply, a plurality of LEDs 83' electrically connected with each other and the battery 82' by electrical wires 831', and a power switch 85' electrically connected to the battery 82' for switching on and off of the alert device 80'.

As shown in FIG. 4, a plurality of LED holders 86' are respectively mounted on the tips 21' of the ribs 20', wherein each LED holder 86' has a narrow entrance passage 861' that leads to an inner LED receiving chamber 862' for receiving the respective LED 83' therein. The diameter of the narrow entrance passage 861' is slightly larger than a diameter of the tip 21' of the rib 20' of the umbrella, so that the LED holder 86' can be slipped and mounted on the tip 21' of the rib 20' of the umbrella.

Moreover, the electrical wires 831' are extended along and below the outer edges 31' of the gores 30' so as to electrically connected the LEDs 83' to the battery 82'. Similarly, a transparent strip 84' is either welded along the outer edges 31' of the gores 30' by ultrasonic welding or sewed on the outer edge 31' of the gores 30' for enclosing the electrical wire 831' in water-sealed manner. The LEDs 83' are respectively placed inside the LED receiving chambers 862' of the LED holders 86' which are fastened on the tips 21' of the rib 20' in water-sealed manner respectively so as to hold the LEDs 83' in position. The corresponding electrical wire 831' is connected to the respective LED 83' through the narrow entrance passage 861' of the LED holder 86'.

Accordingly, a series of LEDs 83' are installed at the tips 21' of the ribs 20' of the umbrella, so that when the umbrella of the second preferred embodiment is used at rainy night, the user may switch on the alert device 80' by operating the power switch 85'. Then, the battery 82' lights up all the LEDs 83' around the umbrella cover 3' to warn the drivers around the umbrella user.

Figure 5:
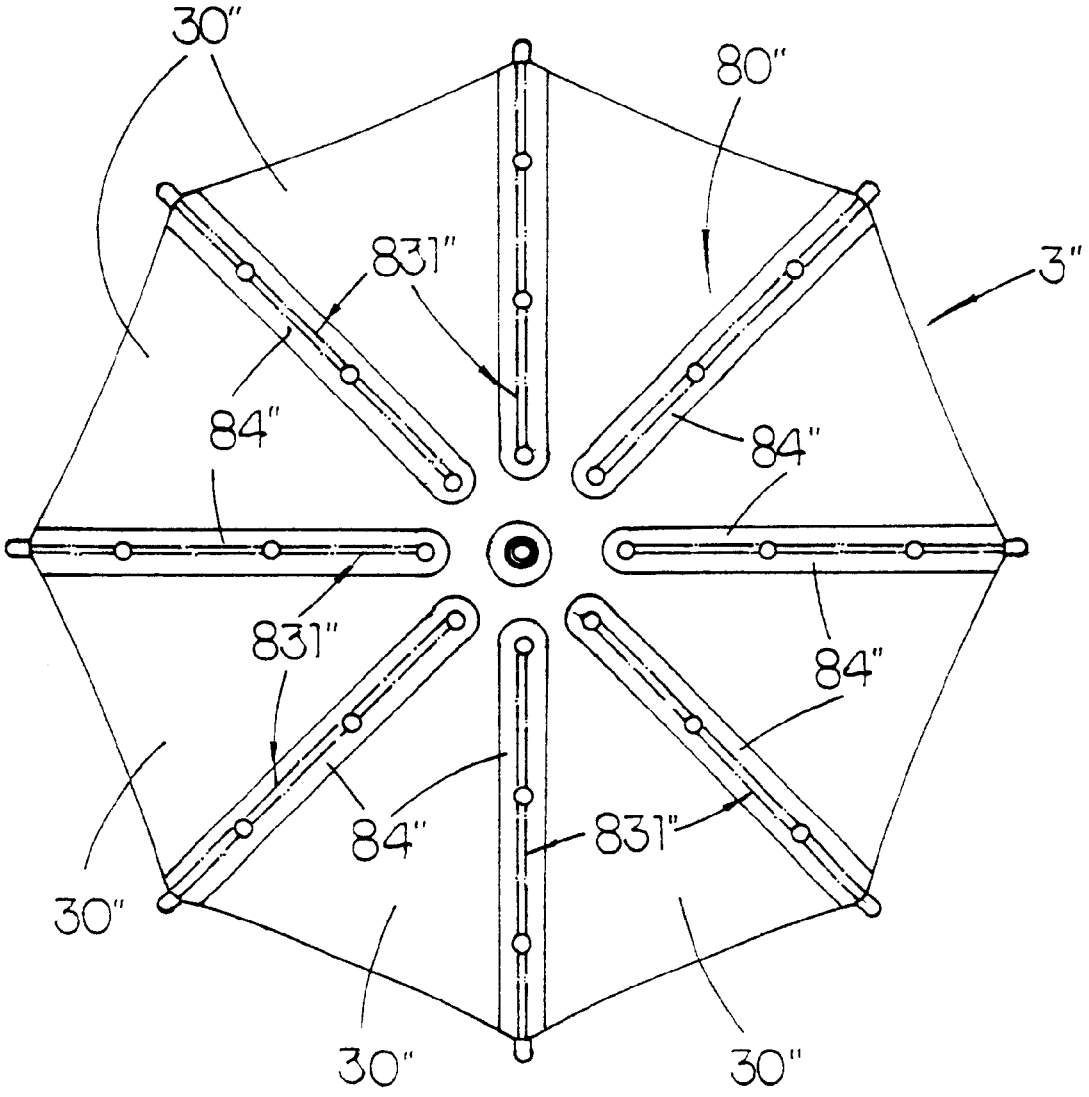
FIG. 5 is a top view of an umbrella with alert device according to a third preferred embodiment of the present invention.
Figure 6:
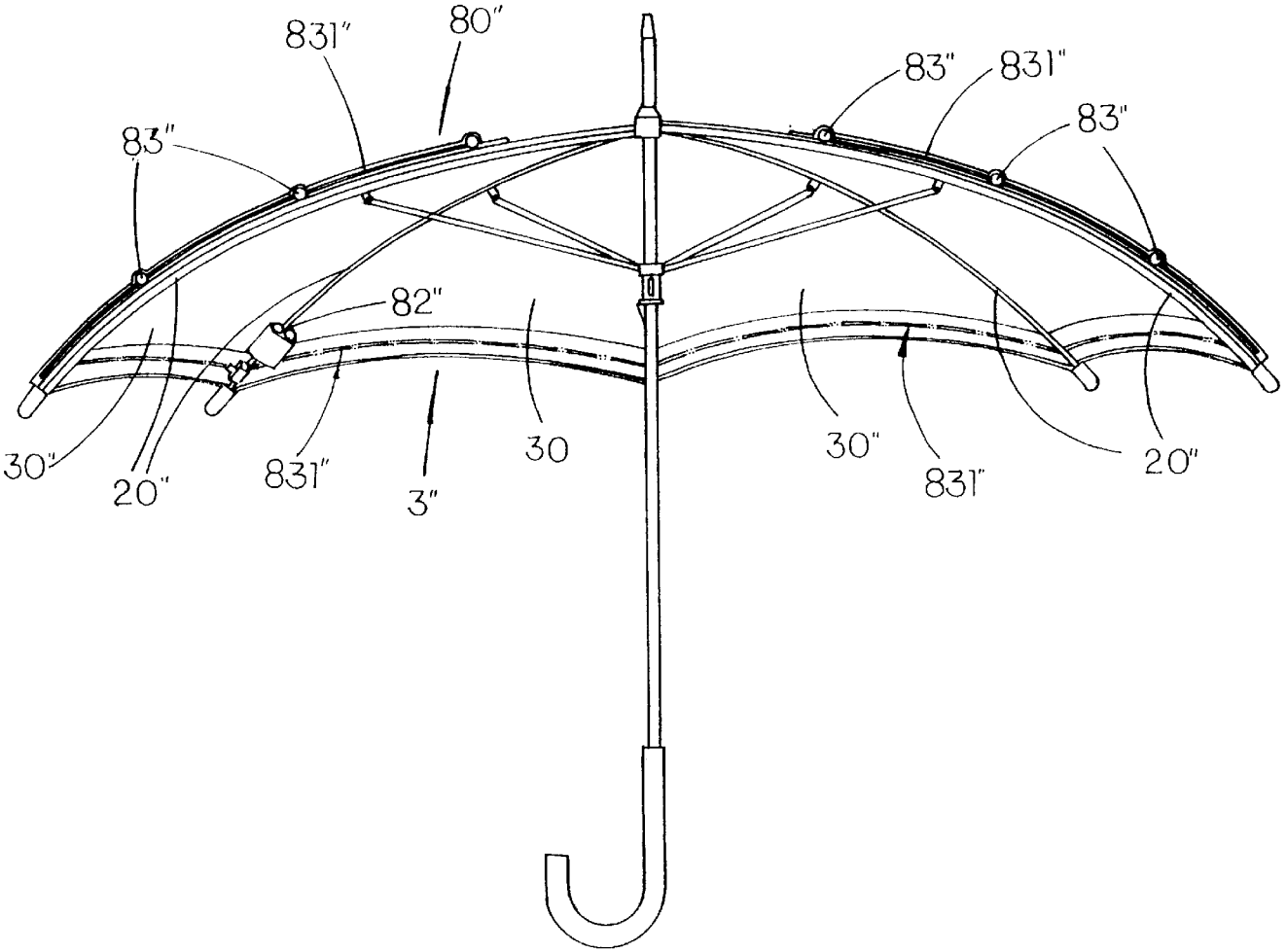
FIG. 6 is a sectional side view of an umbrella with alert device according to a fourth preferred embodiment of the present invention.

Referring to FIG. 5 of the drawing, another alternative mode of the umbrella with alert device according to a third preferred embodiment of the present invention is illustrated, wherein the alert device 80" is similar to the above first and second embodiments. The difference between this third embodiment and the above first and second embodiments is that the plurality of LEDs 83" are respectively and intervally installed along the ribs 20" on the umbrella cover 3". There are a plurality of transparent strips 84" respectively attached along the connecting edges of the gores 30" to sealedly cover the LEDs 83" and the electrical wires 831" connected between the LEDs 83".

It is worth to mention that the alert devices 80, 80', 80" of the above first, second and third embodiments can be combined to installed on the umbrella with a single power source. Furthermore, depending on the quality of the gores 30, 30', 30", if the gores 30, 30', 30" are also made of transparent material that allows the light to pass through, the LEDs 83, 83' or 83" and the transparent strips 84, 84' or 84" can both be installed on the underside of the gores 30, 30' 30". Besides, the transparent strip 84, 84', 84" can be substituted by a transparent tube and the LEDs 83, 83', 83" and the electrical wires 831, 831', 831" are inserted in the transparent tube for waterproof purpose.

What is claimed is:

1. An umbrella, comprising an umbrella frame for supporting a circular umbrella cover made of water proof material to form an umbrella body, wherein said umbrella cover comprises a plurality of gores sewing edge to edge to form a circular covering, said umbrella frame comprising a rod, a plurality of ribs each having a first end jointed at an upper portion of said rod and a second end extended outwardly and downwardly to form a tip for supporting said umbrella cover by fastening said gores thereof on said ribs respectively, a runner slidably mounted on said rod, a plurality of stretchers each having a first end pivotally jointed at said runner and a second end pivotally jointed at a middle position of the respective rib, and a controlling means for operating said umbrella frame to fully stretch out to open said umbrella and to fold up to close said umbrella; and an alert device for providing visual warning signal, wherein said alert device comprises a battery receiver mounted below said umbrella cover, at least a battery stored within said battery receiver for providing power supply, a plurality of LEDs electrically connected with each other and said battery by electrical wires and intervally distributed on said gores of said umbrella cover, at least a transparent strip water-sealedly affixed on said umbrella cover to cover said LEDs and said electrical wires disposed on said gores of said umbrella cover for sealedly isolating said LEDs from outside and holding said LEDs in position, and a power switch electrically connected to said battery for switching on and off said alert device.

2. The umbrella as recited in claim 1 wherein said battery receiver is attached to an underside of said umbrella cover.

3. The umbrella as recited in claim 2 wherein said plurality of LEDs are spacedly disposed around outer edges of said gores of said umbrella cover and said electrical wires which are connected between every two of said LEDs are also extended along said outer edges of said gores.

4. The umbrella as recited in claim 3 wherein said transparent strip is made of waterproof material, which is extended along said outer edges of said gores of said umbrella cover to cover and hold all said LEDs and said electrical wires in position, wherein two sides of said transparent strip are sealedly welded on said outer edges of said gores of said umbrella cover by ultrasonic welding.

5. The umbrella as recited in claim 2 wherein said plurality of LEDs are respectively and intervally installed along said ribs on said umbrella cover and there are a plurality of said transparent strips respectively attached along said ribs respectively to sealedly cover said LEDs and said electrical wires connected between said LEDs.

6. The umbrella as recited in claim 5 wherein two sides of each of said transparent strip are sealedly welded on said outer edges of said gores of said umbrella cover by ultrasonic welding.

7. The umbrella as recited in claim 1 wherein said plurality of LEDs are spacedly disposed around outer edges of said gores of said umbrella cover and said electrical wires which are connected between every two of said LEDs are also extended along said outer edges of said gores.

8. The umbrella as recited in claim 7 wherein said transparent strip is made of waterproof material, which is extended along said outer edges of said gores of said umbrella cover to cover all said LEDs and said electrical wires, wherein two sides of said transparent strip are sealedly welded on said outer edges of said gores of said umbrella cover by ultrasonic welding.

9. The umbrella as recited in claim 1 wherein said plurality of LEDs are respectively and intervally installed along said ribs on said umbrella cover and there are a plurality of said transparent strips respectively attached along said ribs respectively to sealedly cover said LEDs and said electrical wires connected between said LEDs.

10. The umbrella as recited in claim 9 wherein two sides of each of said transparent strip are sealedly welded on said outer edges of said gores of said umbrella cover by ultrasonic welding.

* * * * *